US006267460B1

(12) United States Patent
Gaide et al.

(10) Patent No.: US 6,267,460 B1
(45) Date of Patent: Jul. 31, 2001

(54) TOWEL DISPENSER

(75) Inventors: Albert Gaide, Monnaz; Patrick Besserer, Altstätten; Markus Ehrensperger, Hettlingen; Christian Frei, Oberriet; Hans-Jörg Studer, Hittnau, all of (CH)

(73) Assignee: CWS International AG, Baar (CH)

( * ) Notice: Subject to any disclaimer, the term of this patent is extended or adjusted under 35 U.S.C. 154(b) by 0 days.

(21) Appl. No.: 09/488,718

(22) Filed: Jan. 20, 2000

Related U.S. Application Data

(63) Continuation-in-part of application No. 08/945,178, filed as application No. PCT/CH96/00141 on Apr. 17, 1996, now abandoned.

(30) Foreign Application Priority Data

Apr. 19, 1995 (CH) ..... 1121/95

(51) Int. Cl.[7] ..... B65H 19/00
(52) U.S. Cl. ..... 312/34.11; 312/34.8
(58) Field of Search ..... 312/34.1, 34.8, 312/34.9, 34.11, 34.16, 34.17, 34.19, 34.24; 40/116, 117

(56) References Cited

U.S. PATENT DOCUMENTS

| | | | |
|---|---|---|---|
| 495,980 | 4/1893 | Lazaron | 40/116 X |
| 1,050,539 | 1/1913 | Hendrick | 312/34.11 |
| 1,596,125 | 8/1926 | Steiner | 312/34.9 |
| 1,659,813 | 2/1928 | Hails | 312/34.11 |
| 1,721,928 * | 7/1929 | Steiner | 312/34.11 |
| 1,756,927 * | 4/1930 | Steiner | 312/34.11 |
| 1,840,179 | 1/1932 | White et al. | 40/117 |
| 1,843,658 | 2/1932 | Addler | 312/34.11 |
| 1,899,369 | 2/1933 | Tyler | 312/34.11 |
| 2,144,087 | 1/1939 | Van Schlegell . | |
| 2,234,067 | 3/1941 | Wilkinson . | |
| 5,184,885 | 2/1993 | Arbian et al. | 312/34.11 |
| 5,244,263 | 9/1993 | Kennedy | 312/34.11 |
| 5,820,231 | 10/1998 | Schon | 312/34.11 |

FOREIGN PATENT DOCUMENTS

| | | | |
|---|---|---|---|
| 787212 | 12/1957 | (GB) | 312/34.11 |
| 9632874 | 12/1996 | (WO) . | |

* cited by examiner

*Primary Examiner*—Peter M. Cuomo
*Assistant Examiner*—James O. Hansen
(74) *Attorney, Agent, or Firm*—Schweitzer Cornman Gross & Bondell LLP

(57) ABSTRACT

A towel dispenser is provided with a pivoting unit into which a winding roller driven by way of a friction drive is mounted in an easily suspensible manner. An additional loop, which is tightened by a compensator roller in a direction +p, is formed in the dispenser in front of the winding roller, and when clean towel is pulled down a portion of used towel (T') is used to form the rear part of a loop of cloth (T; T') used in the front part. Changing used cloth (T') and loading with clean towel (T) is performed by rotating the pivoting unit, can be carried out in a very simple manner and is completed by opening or closing the cover of the dispenser. A path- and time-dependent control of the towel delivery is integrated in the dispenser.

13 Claims, 12 Drawing Sheets

TOWEL DISPENSER

The present application is a continuation-in-part of application Ser. No. 08/945,178 filed Oct. 16, 1997 now abandoned, which is a national stage of PCT/CH96/00141 filed Apr. 17, 1996.

The present invention relates to a towel dispenser.

BACKGROUND OF THE INVENTION

Known towel dispensers (inter alia EP-A1-0 283 544) require a threading-in of the cloth and an additional winding around a roller when they are used. In order to prevent the end of a towel roll from being used several times, the end is retracted as soon as it would hang freely, i.e. as it is wound off from the clean towel roll. The force required for the retraction is stored in a spring drive; to this end, however, the energy for the retraction of the respective portion of soiled towel has to be built up and made available. Each time the towel roll is changed, therefore, the supply or delivery roller is wound up manually in the correct direction for the cloth, and this results in frequent problems. After the winding up has taken place, a certain length of unused cloth must consequently be drawn off for the initial loading of the stored spring force, so that the first used portion is already drawn in and an excessively long loop hanging out of the dispenser is not formed. In the event of breakdowns in the dispenser the drawn-in cloth cannot be withdrawn; it must first be completely unwound onto the soiled roll and is thus lost.

Experience has shown that the above-mentioned conditions for the correct loading of a dispenser with cloth are the cause of numerous breakdowns, which constitute a sequence of lack of understanding, incapability, erroneous interpretation and false alarms and very often put a dispenser out of action for this reason. Since a premature changing of the rolls results in the loss of the cloth not yet used and because of the inherent susceptibility of these dispensers to breakdown, it has been suggested that two towel units, and in practice two complete towel dispensers, should be constructed one beside the other and should be coupled to each other mechanically in order to increase the operational readiness of the entire unit.

A threading-in of a towel which is at least partially automated is likewise known (W-OA1-96/32874). It has been found, however, that a dispenser of this type either requires auxiliary energy and/or special measures at the end of the towel, which have an adverse effect on the washing process In addition, it has been found to be disadvantageous that in the case of the dispenser according to EP-A1-0 283 544 the roll of soiled cloth can roll off by vigorous pulling on the rear part of the loop, since the slip clutch required for the return of used fabric—for forming a temporary loop sufficient for drying—cannot put up an adequate resistance.

The object of the invention is therefore to provide a compact towel dispenser which does not have the drawbacks mentioned above. In particular, with a minimum of necessary instruction to the maintenance staff, a towel dispenser in accordance with the invention should provide the user with a maximum possible degree of operational reliability and hygiene. The dispenser should keep ready the available roll of towel in optimum portions and permit neither deliberate nor undesired multiple use of the towel. In particular, the roll of towel thereof has to be easy to change, i.e. it should be easy to load in the dispenser. In the event of a possible premature change of the towel roll it should not be necessary to re-wind the towel.

The necessary operations should not require any instructions. No extraneous energy should be necessary; and the dispenser's operations should have a high degree of reliability.

For hygiene considerations the used cloth and the clean cloth must be guided completely separately from each other over the entire conveying path. In addition, the cycle times of the dispenser should be reproducible and adaptable to what the users are used to, i.e. it should be possible for the same type of towel dispenser to be used in a manner which is satisfactory in every respect for a wide range of use environments, such as from the requirements of an old-peoples home, through a central administration of a bank to a fast-food restaurant on a motorway.

Furthermore, the dispenser must be suitable and economical for mass-production manufacture; for space considerations and cost, appliances arranged one beside the other are not desired.

The strip material used as the towel should not as a rule require any steps or changes with respect to that in existing dispensers installed and used in numerous locations, since further use is to be made of the existing infrastructure such as washing machines, mangles and drying plants, as well as the existing logistics associated therewith. A dispenser in accordance with the invention should not, however, be restricted to the use of textile strip material; it should be capable of being adapted to any environmentally acceptable, durable material.

BRIEF DESCRIPTION OF THE INVENTION

In accordance with the forgoing and other objects and purposes a towel dispenser for flat strip material of the present invention includes a conveying mechanism for the simplified threading-in and for forming a loop of clean strip material suitable for drying the hands. The conveying mechanism is provided with a pivoting unit rotatable outwards about a stationary shaft mounted in side panels, the conveying mechanism beings initiated or activated by closing the dispenser and/or by a manually activated drive member. The strip material rolls off in metered portions from a supply of clean material by way of a dispensed loop onto a replaceable collection roller for used material. The pivoting unit is provided in its upper region with bearing points for inserting a removable winding roller. A recess for forming an additional loop of strip material is provided between the winding roller and a guide for the strip material.

The additional loop is provided as an addition to the loop issuing from the dispenser and intended for drying the hands and is arranged behind the issuing loop inside the dispenser. With each portion of towel dispensed, the towel already used and present in the additional loop can thus be utilized in an hygienically proper manner in order to form the loop intended for drying the hands, without the winding roller loaded with used, crumpled and damp towel being rotated first backwards and then in the winding direction again. This leads to a saving of almost 50% in towel consumption, without having to run the risk of breakdown during the winding etc. The user is provided with a convenient and ergonomically advantageous access to the cloth.

The specific term "recess" is to be understood in the widest sense of "space" for guiding an additional loop; this loop can also be formed, however, by rotating the pivoting unit. Because of the given cloth width and the restricted spatial conditions the said loop is present in each case in the pivoting unit and in front of its winding roller for used cloth.

A towel dispenser according to the invention does not require any instruction for maintenance; simple pictographs and/or directions on the dispenser can be sufficient for trouble-free set up and maintenance. No extraneous energy is required and the forces necessary for control and operation are applied unconsciously by the user. All the functions take place in a reproducible manner and with suitable means they can be adapted and/or even set to the local requirements.

A compensating roller for tightening the inner (additional) loop also has the effect, in addition to the intended return of the used cloth to form an outer loop, of smoothing and partially drying the crumpled and damp portions of cloth. The provision of an axially parallel guidance for the used cloth can ensure a clean winding and thus prevents shifting with respect to the desired symmetrical running of the cloth. Such guides may be advantageously formed in the stationary side panels of the appliance housing.

The compensator roller can be controlled on its oscillating path set during each delivery of cloth by cable lines provided with springs, without the lateral space requirement in the dispenser being increased. A precise and slippage-free guidance can be made possible by a positively locking rolling action of the compensator roller.

The incorporation of a spring loaded gripper rocker may allows particularly simple coupling of the movement of the compensator roller in conjunction with the opening and closing of the cover of the dispenser.

The arrangement for vertically adjustable mounting of the fabric receptacle can result in a particularly space-saving compact dispenser which performs the necessary movements when the cloth is changed, without parts of the appliance having to be moved manually. In addition, the transmission of force by means of a friction roller resting on the winding roller and situated on the fabric receptacle allows the volume released as the clean cloth rolls off to be utilized by the roll of used cloth which increases in diameter at the same time.

A drive by way of the side panel can allow the necessary path-dependent synchronism between the delivery roller and the winding roller to be controlled with respect to time and to be monitored.

Guide grooves can be designed and configured to result in a compact design and a trouble-free transmission of force since a curved groove arranged concentrically to a central gearwheel ensures a constant engagement with the transmission or driving gearwheel of the winding roller.

Pins projecting on the fabric receptacle are advantageous guides in one plane. The guidance of the fabric receptacle can be further improved in a plane at a right angle to the first one. An optimum parallel guidance of the fabric receptacle and thus of the friction drivecan be made possible by gearwheels connected to one another.

The lifting of the fabric receptacle can beprovided in order to rotate the pivoting unit forwards by about 180° and to unload it or to prepare it for re-use. Such a position pivoted out of the dispenser also allows the pivoting unit and optionally further parts of the towel dispenser to be cleaned and/or disinfected in a convenient manner.

A lateral arrangement of the control and drive device can produce a kinematically advantageous solution and results in a single functional unit which is easy to replace and is advantageous in terms of manufacturing.

As the vertical position of the fabric receptacle is directly dependent upon the winding diameter of the roll of used cloth, since the friction roller situated below the fabric receptacle rests on the winding, a filing-state indicator relying on such a relationship can be employed. In practice, before the supply of clean cloth is used up, a vertical red line appears in an inspection window at the front of the cover.

BRIEF DESCRIPTION OF THE DRAWINGS

A preferred embodiment but nontheless illustrative embodiment of the invention is set fort in the following description, to be considered with reference to the annexed drawings, in which.

DETAILED DESCRIPTION OF THE INVENTION

Figure 1:
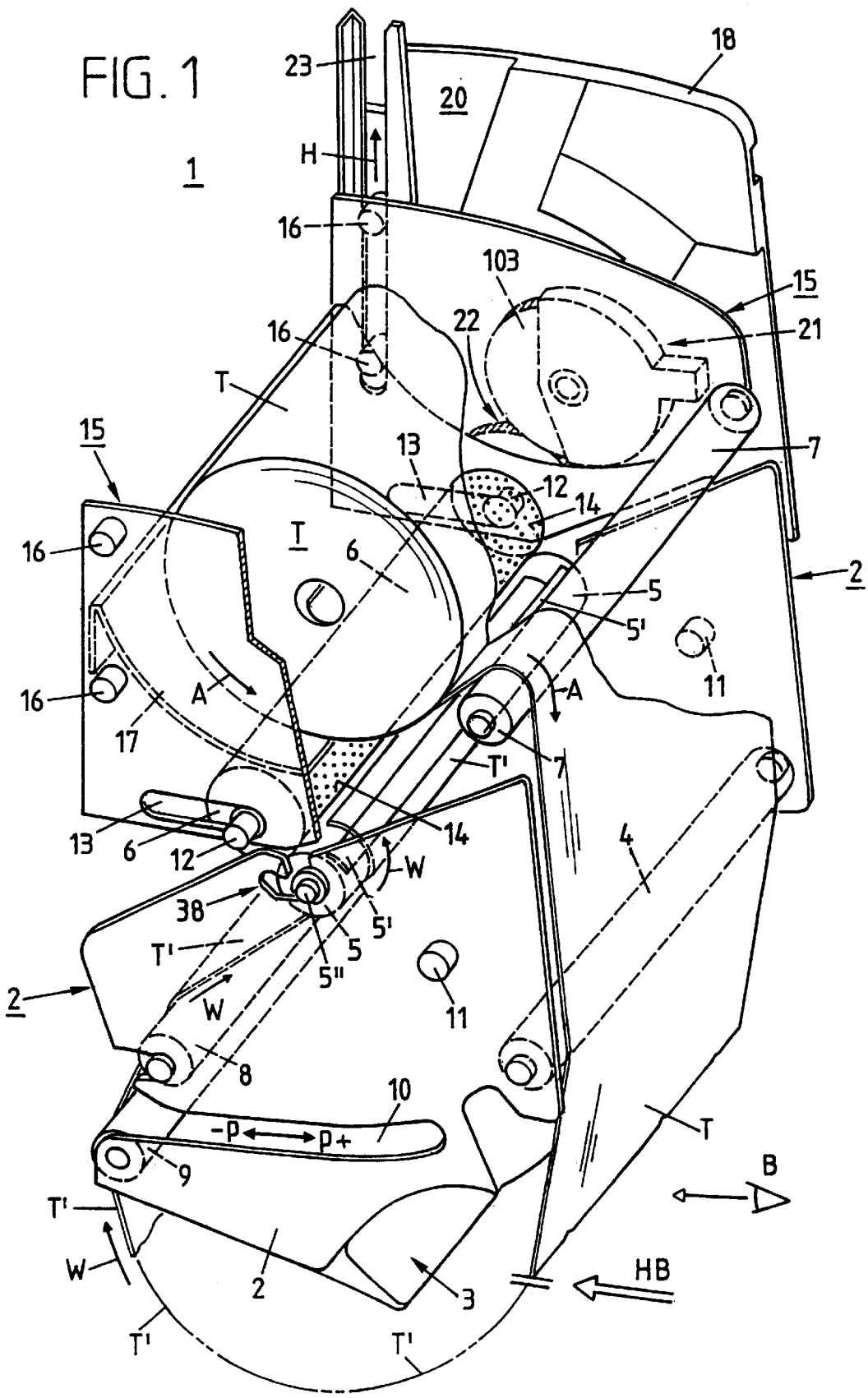
FIG. 1 is a simplified perspective illustration of a towel dispenser with the essential functional members thereof, without time-dependent control and without a cover being shown.

A towel dispenser according to the invention is designated 1 in FIG. 1; the perspective illustration shows it without a cover (covering) and without a side panel at an end, during drying of the hands by a user B.

Two basic components, namely a pivoting unit 2 with shell-shaped guide and gripping recesses 3 and a fabric receptacle 15 situated thereabove in a compact manner for a roll of clean cloth T, are supported and guided by side panels, only the right-hand side panel 18 of which is shown. The roll of cloth rests freely movable on a shell-shaped trough 17 and is not provided with a winding spindle. Its strip-shaped cloth T is guided in the direction of unwinding A over an upper deflecting roller 7 onto a lower deflecting roller 4, is guided in the pivoting unit 15 and forms a depending loop which is used for drying the hands HB of the user B in the usual manner at the point indicated by parallel lines. The cloth T' used in this way is guided in the direction W over further deflecting rollers 9 and 8 to a winding roller 5.

The winding roller 5, together with a clamping spring 5' and bearing pins 5" is used for winding up the used cloth T' in the winding direction W.

The bearing pins 5" are supported in insertion points or notches 38 in the upper edge areas of the pivoting unit 2, where they are held in a rotatable manner in an end position. The winding roller 5 is driven by a friction roller 6 resting thereon and having a nubbed friction face 14 which rests directly on the used cloth T' and drives the latter in the direction W with a time delay, after the hands have been dried. The friction roller 6 is guided movably on the shaft pin 12 at the ends thereof in the horizontal guide grooves 13 in the lower part of the fabric rentable 15, so that it can be adapted to the increasing diameter of the rolled-up cloth T'.

The fabric receptacle 15 is in turn movable upon guide pins 16 projecting outwards on its lateral faces in the lifting direction H in mutually opposed guide grooves 23 on both sides, only one guide groove 23 being visible in the side panel 18. In addition, a depression 20, which is enlarged upwards and which is used for the convenient assembly of the fabric receptacle 15 with the projecting shaft pins 12 thereof in the dispenser 1, may be seen in the side panel 18.

The pivoting unit 2 covers a gearing mechanism for a friction drive, so that the gearing mechanism is shown hatched. The gearing mechanism 22 is driven by a central gearwheel 103 which projects out of a housing 21.

The pivoting unit 2 is rotatable about the two likewise projecting shaft pins 11 thereof, i.e. as described in greater detail below the pivoting unit can be pivoted outwards about the said shaft pins 11 so that the roll of used cloth T' can be removed from the front, as viewed from the position of the user B. The winding roller 5 remains in the dispenser 1 and is removed axially out of the roll T' and a new clean end of a cloth T is pulled below the clamping spring 5'. The winding roller 5 is repositioned again in the insertion point 38 and the unit 2 is pivoted back into the position indicated.

In order that the unit 2 can be pivoted out, the fabric receptacle 15 has to be moved upwards. This is carried out by way of a pivoting lever 47 connected to the cover of the dispenser, see FIG. 5.

In addition, as shown in FIG. 1 a recess 10 is provided for a compensator roller which in this figure has been omitted for clarity; only its oscillating directions p are indicated. The compensator roller is described in detail in the following FIGS. 7 to 10, but the operation thereof can be indicated at this point:

When fresh cloth T is pulled down by the hands HB, the compensator roller situated in front is retracted in the direction −p, so that a part or portion of used cloth T'—is likewise released. This corresponds to 50% of the entire length of the loop of cloth comprising T+T'. In this way, the loop is increased for convenient drying of the hands, without an unnecessarily large amount of clean cloth T being required.

Figure 2:
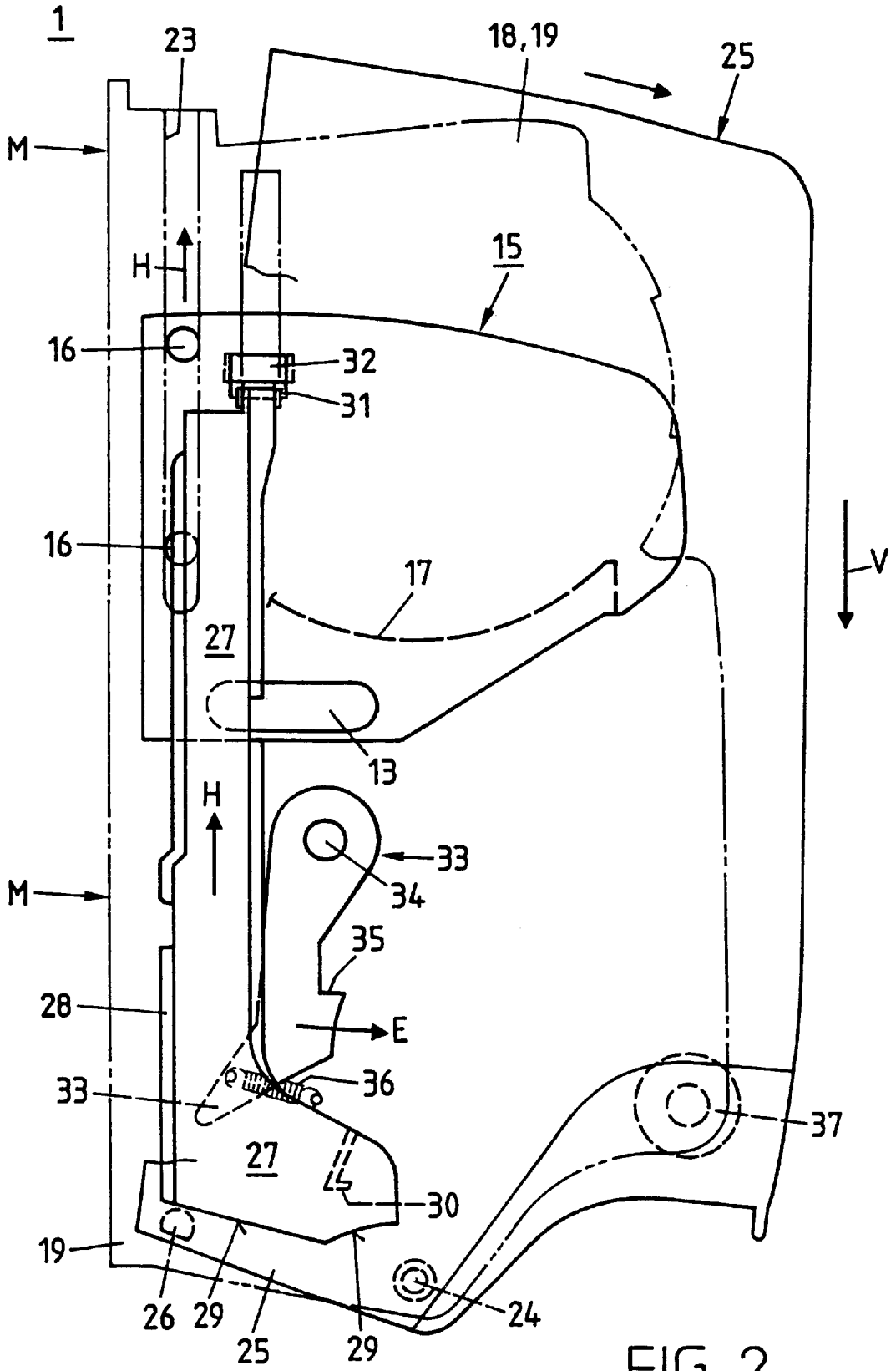
FIG. 2 is a basic illustration of the dispenser of FIG. 1, in a plan view from a narrow side, with a cover opened about 7°.

In FIG. 2 the dispenser 1, mounted with the mounting face M on a vertical wall, is shown in a first lockable tilting position with the cover 25 at an inclination of 7 to the vertical V. This is the first position to be set on the dispenser when opening the cover 25.

The cover 25 is provided on both sides with a respective bearing pin 24, which pins 24 are mounted in the side panels 18 and 19 indicated. When the cover 25 is tilted as illustrated—after opening a closure (not shown)—a slide cam 26 presses against a slide 27 arranged vertically and provided with sliding faces 29. The slide 27 is provided at the side with with guide strips 28 which prevent the slide from tilting, so that a lifting movement H is transmitted by way of the lifting cam 31 thereof to a projection 32 on the fabric receptacle 15 and likewise lifts it.

Figure 9:
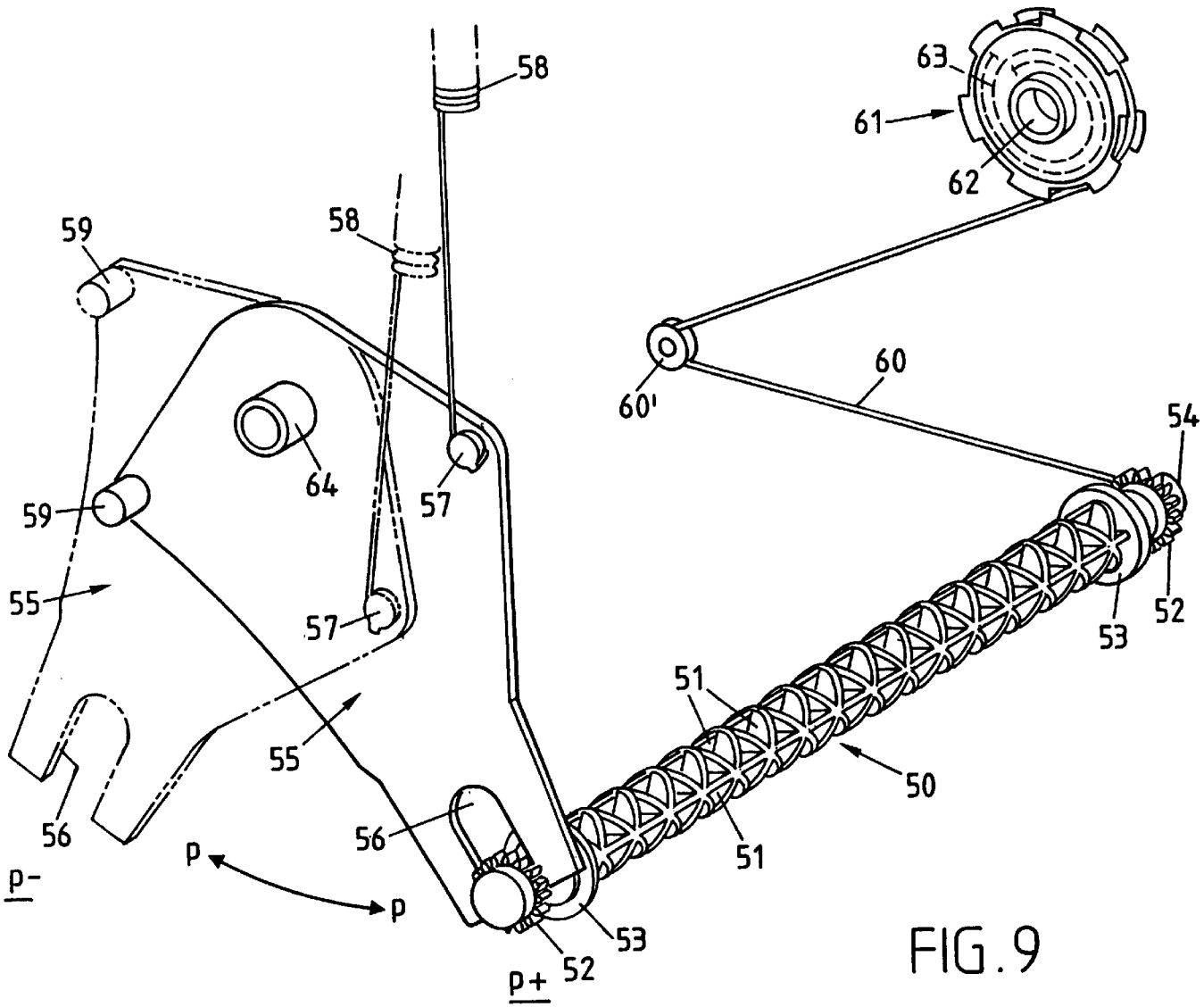
FIG. 9 is an illustration showing a manner of operation of a compensator roller used for an economical delivery of the towel.

The slide 27 is provided on an inward side thereof with a further ramp-shaped sliding face (not shown for clarity) on which an entraining pin 59 of a gripper rocker 55 rests—see FIG. 9—so that the said gripper rocker 55 is jointly moved with thes slide.

The inward side of the slide 27 has additionally attached thereto a pawl-like cam 30 into which a shoulder 35 of a locking pawl 33 rotatable on a bearing pin 34 engages when the slide 27 is raised sufficiently. The locking pawl is drawn in the catching direction by a restoring spring 36. In addition, a delivery roller 37 likewise provided with nubs may be seen at the front in the cover 25.

Figure 3:
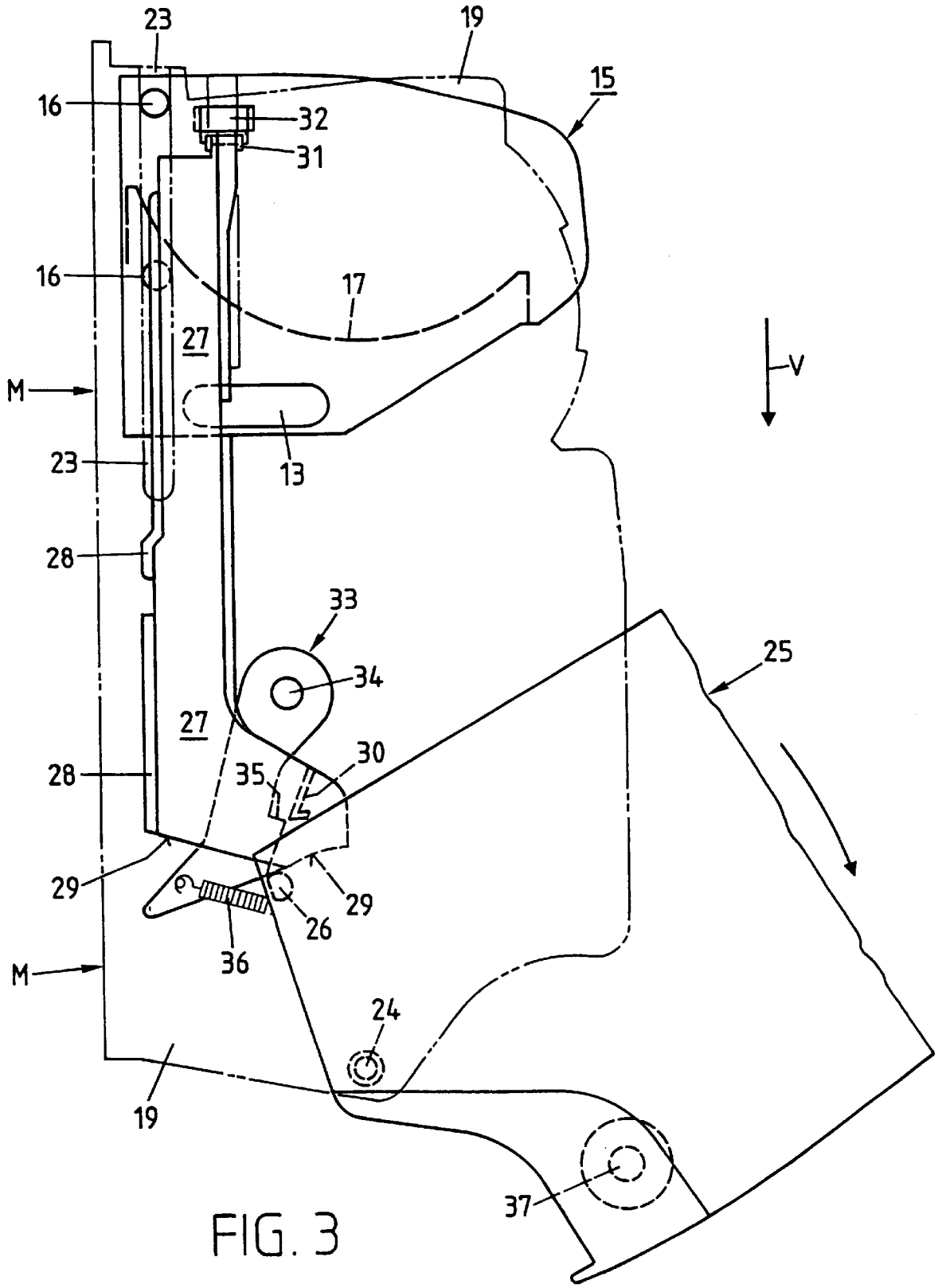
FIG. 3 shows the dispenser of FIG. 2, after the cover has been opened by 60°.

FIG. 3 represents a snapshot at an opening angle of the cover of 60° to the vertical V; the slide cam 26 has already travelled over the lowest part of the sliding face 29 and now moves on the upwardly guiding part of the sliding face 29. The cam 30 is just about to engage with the projecting shoulder 35.

Figure 4:
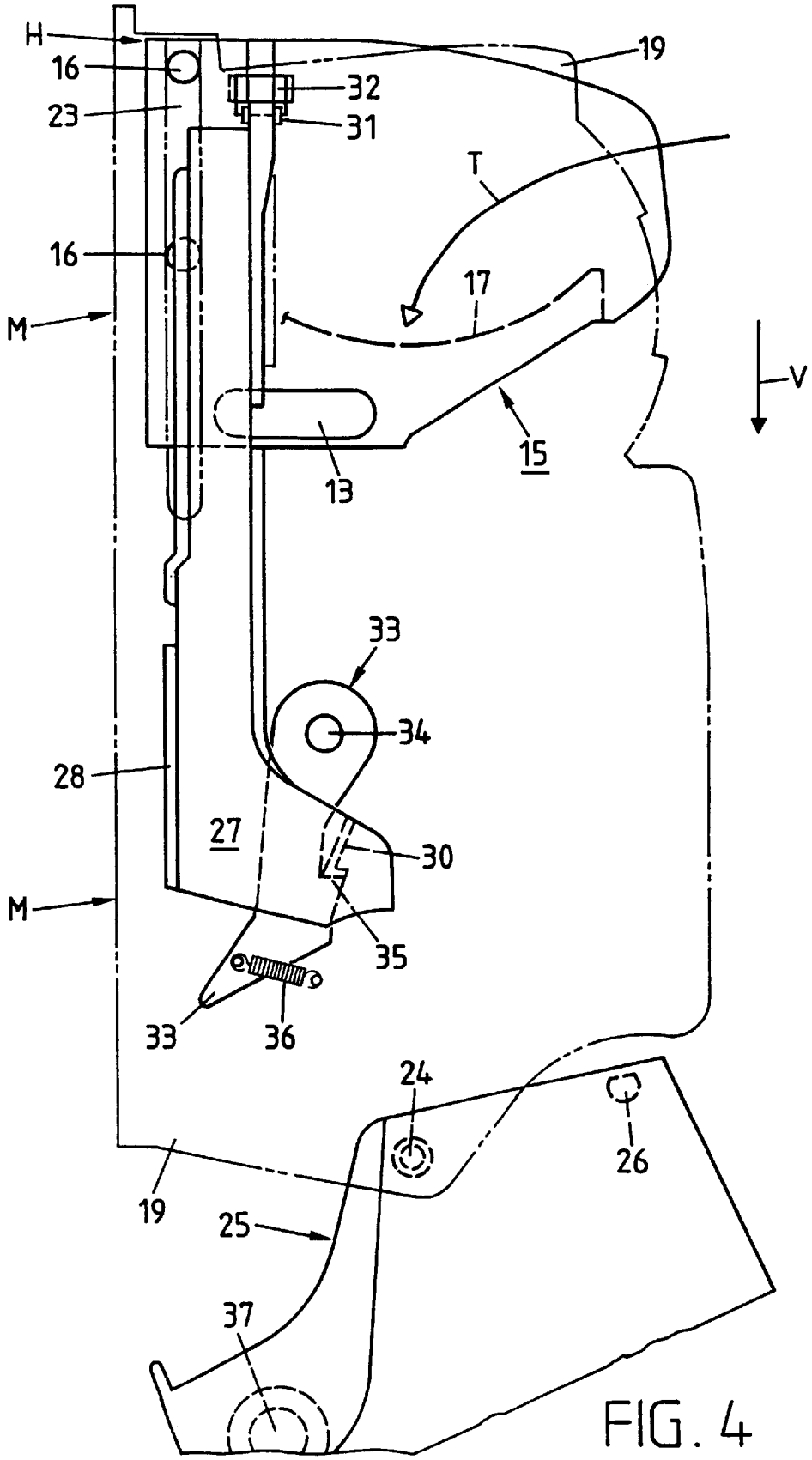
FIG. 4 shows the dispenser of FIG. 2, with the cover opened to the maximum extent and with a fabric receptacle held at the top.

FIG. 4 shows the cam 30 in the engagement position thereof on the shoulder 35; the fabric receptacle 15 is raised to the maxim height H and can be loaded with a roll of clean cloth T.

Figure 5:
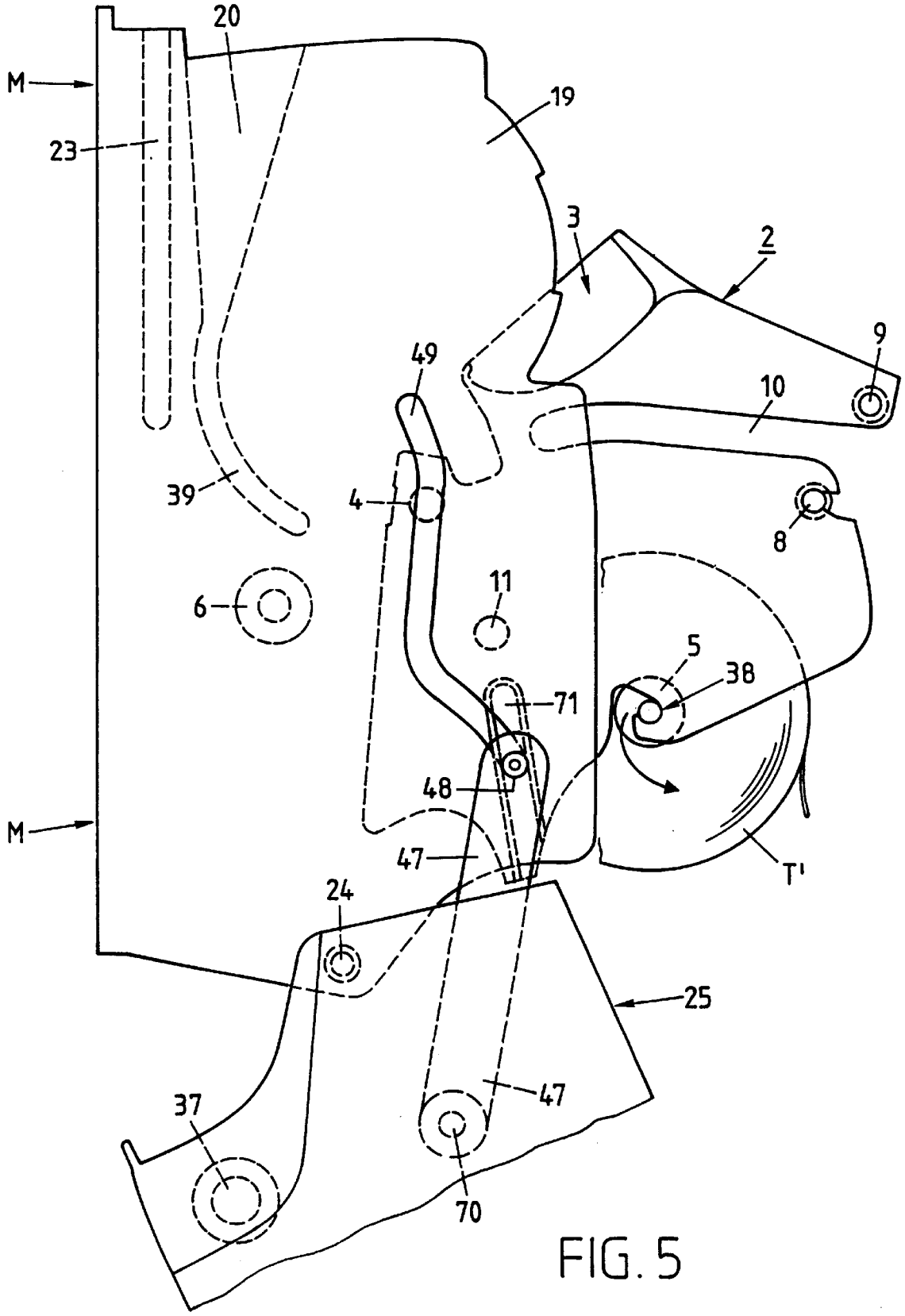
FIG. 5 is an illustration similar to FIG. 4, but with the pivoting unit shown with the associated transfer members.

For the sake of clarity the movement and the transmission of force from the cover 25 to the pivoting unit 2 have been omitted in FIGS. 3 and 4. For the same reason the fabric receptacle 15 is not indicated in FIG. 5. When the cover 25 is opened to the maximum extent, in the position identical with FIG. 4, the pivoting unit 2 is pivoted outwards so that it occupies a position as shown in FIG. 5. In this position it is evident that during the opening movement of the cover 25 a pivoting lever 47 mounted rotatably on the said cover 25 on a connecting pin 70 pivots—with its pin 48 projecting into a straight guide slot 71 in the pivoting unit 2—the pivoting unit 2 about its shaft pin 11. This pivoting movement is controlled by the other side of the shaft stub constructed in the form of a double pin 48 in accordance with the curve of a further guide slot 49 provided in the side panel 19, cf. FIG. 10.

As shown in FIG. 5, with the cover fully open it is easy to lift the winding roller 5 out of its bearings, the mutually opposed insertion points 38, along with a fully loaded roll of soiled cloth T'. The winding roller 5 can be recovered for the following application by simply withdrawing it axially from the soiled cloth roll.

For loading, a roll of clean cloth T is placed in the fabric receptacle 15 in the position according to FIG. 4, in such a way that the free end of the roll rests on the trough 17. The winding roller 5 is now inserted laterally into the free end of the cloth T at an angle of 90° to the direction of unwinding A, in which case the cloth T is clamped in a non-slipping manner between the actual roller 5 and a clamping spring 5' attached thereto.

Figure 6:
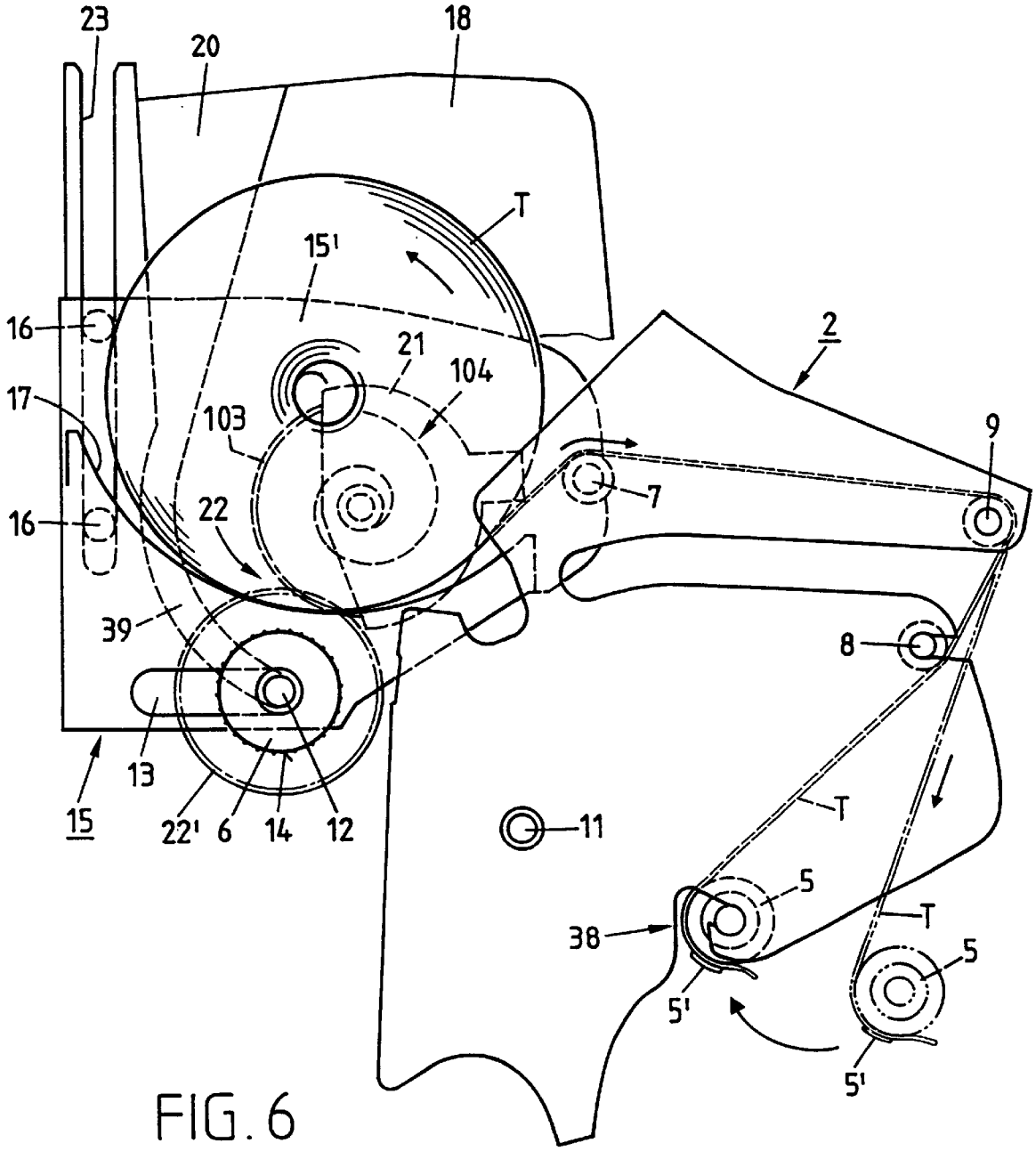
FIG. 6 is a simplified illustration of the functional members in the positions according to FIG. 4 and FIG. 5, during loading.

The actual loading is illustrated in FIG. 6:

The clean cloth T is made to hang down from its roll over the front deflecting roller 9, and the winding roller 5 is pressed into the front end part of the cloth T as described. For the sake of clarity the cover 25 has been omitted here as well, so that the delivery roller 37 mounted therein and driven by way of the gearwheel cf. FIGS. 2 to 5, is likewise absent below the deflecting roller 4—FIG. 1—as also in the subsequent Figures.

The winding roller 5 is then, as shown, inserted into the insertion points or notches 38 in the direction of the arrow, whereupon the manual loading as such is concluded; now the cover 25 is then merely closed. A kinematic reversal of the procedures already described with reference to FIGS. 2 to 5 takes place; finally the appliance appears as shown in FIG. 7.

In this Figure the compensator roller 50 is also clearly visible, which tightens the cloth T' since it is rolled in the direction +p by a gripper rocker 55, FIG. 9. The cloth T occupies the path characterized by the double line shown in the lower part of the pivoting unit 2. After pulling vertically downwards with both hands HB at the point indicated, the compensator roller 50 is set in the front position thereof, as a result of which—due to the retraction of the compensator roller 50 in the direction −p—substantially twice the length of fabric than was delivered over the deflecting rollers 7 and 4 is available at the next hand drying.

In all the Figures the same consistent lettering is applied in the designation of the cloth in the dispenser ready for operation: clean cloth=T; used cloth or cloth behind the point characterized in FIG. 1 (hands HB)=T'.

Figure 7:
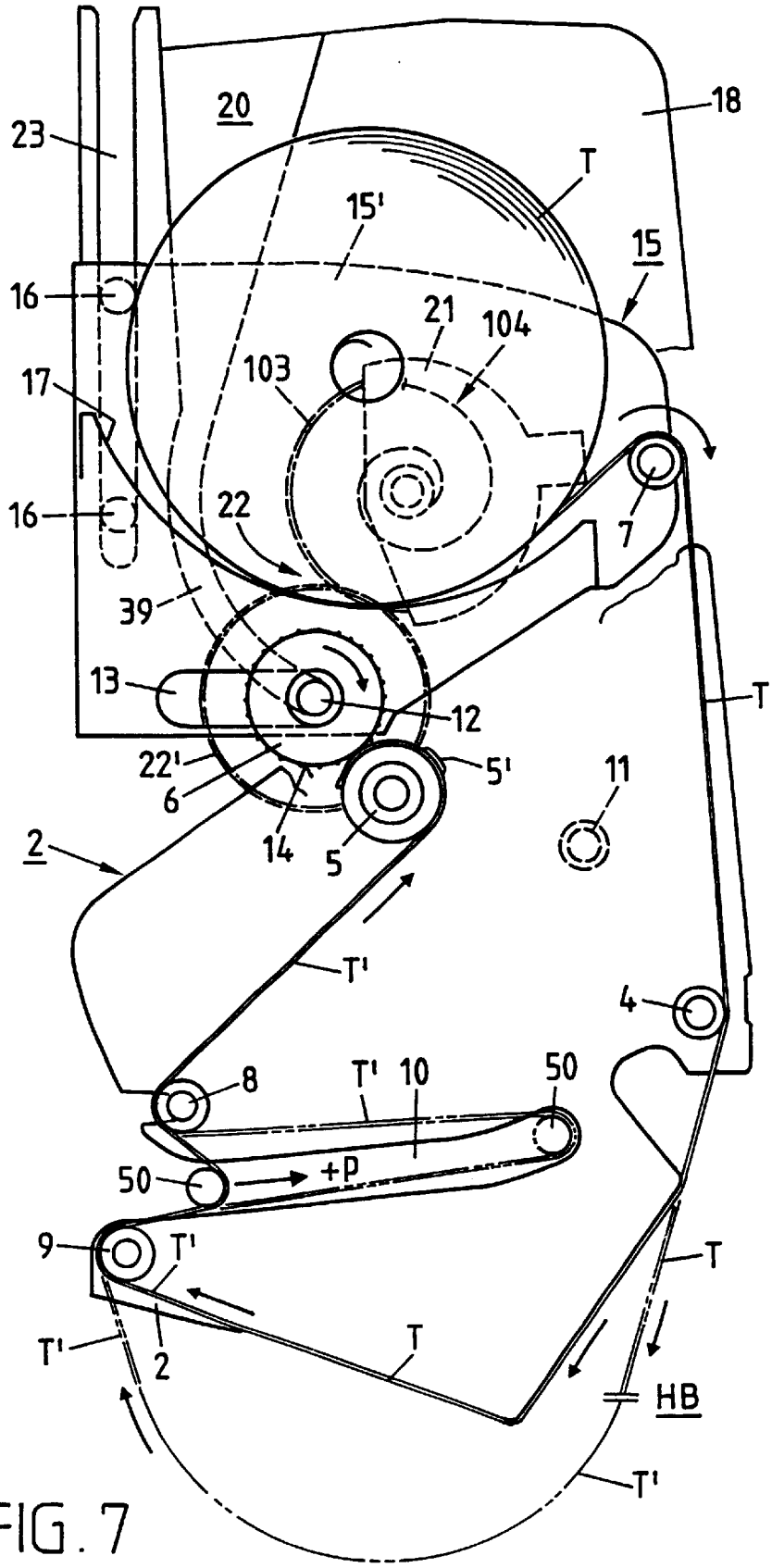
FIG. 7 is a plan view from a narrow side of the dispenser according to FIG. 1 ready for operation after loading.
Figure 8:
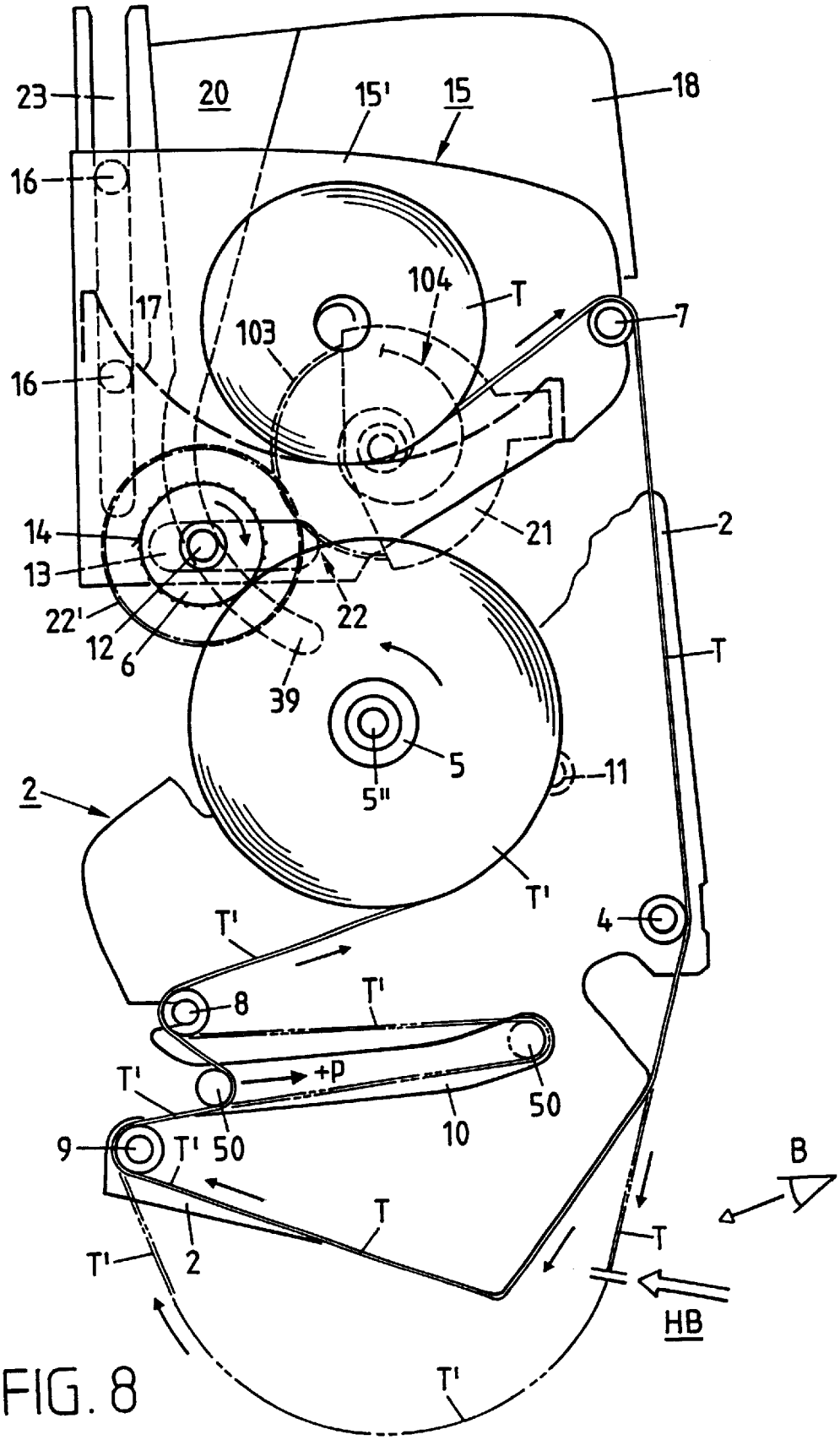
FIG. 8 shows the dispenser of FIG. 7 after a prolonged operating period.

Whereas in FIG. 7 a fresh roll of cloth T is illustrated, in FIG. 8 a major part of the roll is presented as used cloth T' on the winding shaft 5. Consequently the friction roller 6 resting on the roll T' is displaced to the left in the guide groove 13 and at the same time is lifted on the path of the curve 39 in a concentric manner with respect to a central gearwheel 103.

As a result of the illustrated sheet guidance of the friction roller 6, the transfer gearwheel 22' thereof, irrespectively of the current diameter of the winding roller 5 around which the used (soiled) cloth T' has been wound, remains in engagement with the central gearwheel 103, so as to ensure a slippage-free transmission of force.

The friction contact between the used cloth T' and the friction roller 6 driven in this way is advantageous, but in the case of a fresh roll of cloth T almost its entire weight rests on the winding roller 5 or the cloth T' respectively by way of the friction face 14. When the two roll diameters first approximate each other during operation and then change in the opposite direction, the moments which are applied at the contact faces between the friction roller 5 and the cloth T' likewise remain substantially constant.

The design of the compensator roller 50 may be seen in FIG. 9; it has a structure with notches 51 and is provided at the ends with flange-like lateral guides 53 and respective gearwheels 52 which are used for parallel guidance. On the left-hand side of the compensator roller 50 the recess 56 of a gripper rocker 55 engages over the shaft of the compensator roller 50. The gripper rocker 55 is mounted on a bearing pin 64 so as to be pivotable in the direction p and it is provided on a top side with a tension-spring fastening 57 to which a tension spring 58 arranged substantially vertically is connected. The entrainment pin 59 is used for the forced actuation of the compensator roller 50 by the slide 27, FIGS. 2 to 4, as a function of the position of the cover (not shown).

A bearing pin 54, on which a traction cable 60 is suspended, is inserted in a rotatable manner on the right-hand side of the compensator roller 50, the traction cable 60 being guided over a cable pulley 60' to a winding coil 61 and being wound up and held taut by an integrated spiral spring 63 of the winding coil 61. A bore 62 in the winding coil 61 is likewise mounted rotatably in a portioning wheel (not shown) for the delivery of the cloth.

Figure 10:
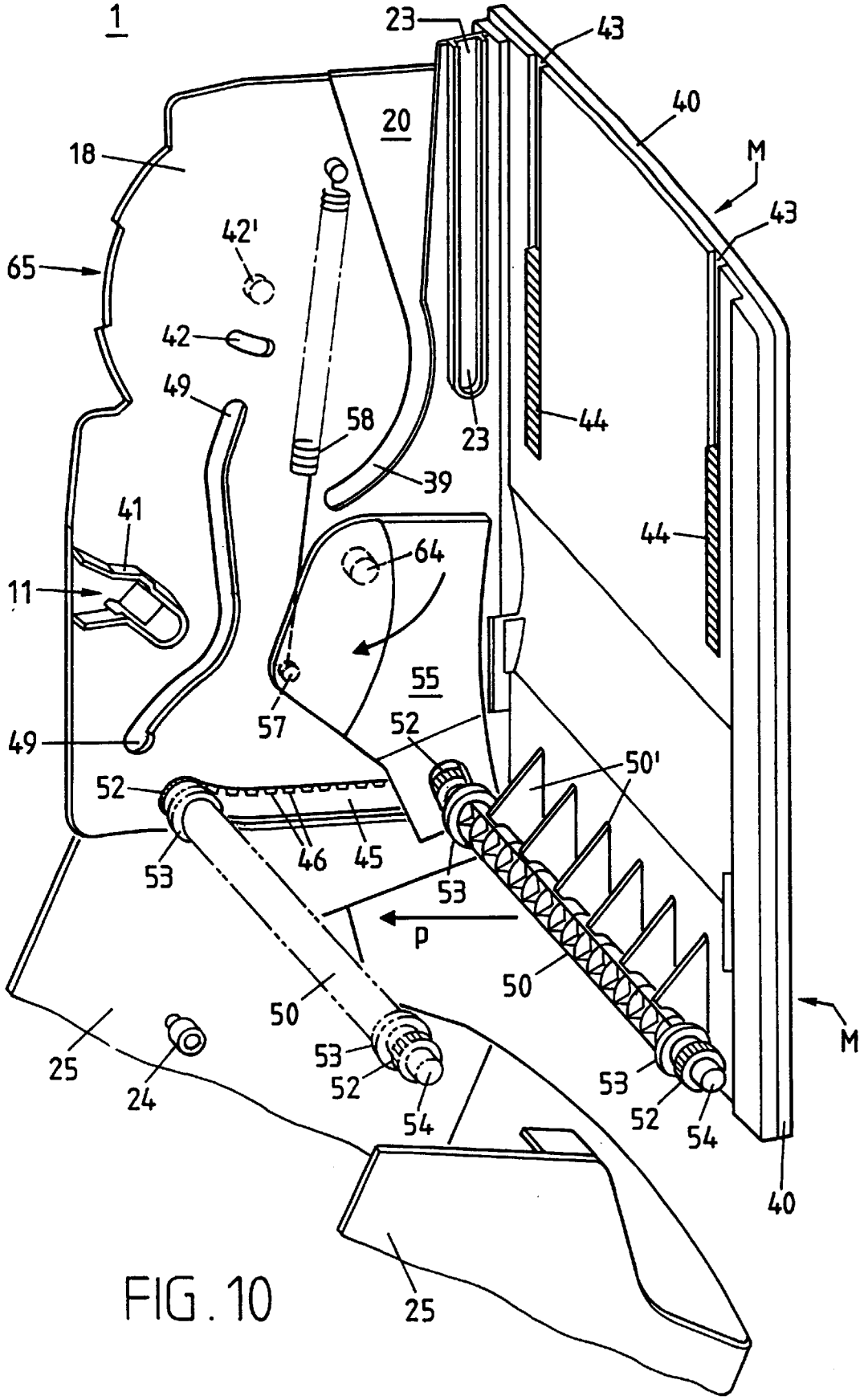
FIG. 10 is a further perspective illustration of the dispenser with essential slotted guides and with the compensator roller in alternative end positions thereof.

In FIG. 9 the compensator roller 50 is shown in the rear position thereof, in a similar orientation as in FIG. 10, where it rests against path-limiting members 50'. Its parallel guide 45 with a parallel set of teeth 46 at the top is seen, which guides the roller in an axially parallel manner into the front position as indicated with broken lines. The oscillation path is again designated p.

FIG. 10 shows the dispenser 1 partly dismantled. In this case the rear wall 40 of the appliance housing is seen, which is attached with its mounting face M to a vertical wall in the usual manner. Here it can be seen that opening the cover 25—by way of the slide 27 (not visible here)—results in both the compensator roller 50 and the fabric receptacle 15 being guided out of the region of rotation of the pivoting unit 2 and the said pivoting unit 2 being pivoted into the position shown in FIG. 6 in the manner described above.

A side panel 18, which carries a guiding and bearing point 41 for a shaft pin 11 of the pivoting unit (not visible), projects at a right angle to the rear wall 40. Adjacent is a curved slotted guide 49, which likewise guides the pivoting unit 2. A recess, which is used for the pin guide 42 of a filling indicator for the cloth T, may be seen in the upper region of the side panel 18. Beside it is the above-mentioned tension spring 58 which is connected to the gripper rocker 55 by the tension-spring fastening 57.

In addition, the guide groove 39 may be seen, which extends concentrically with respect to the central gearwheel (not visible here) and which is used for guiding a friction drive which is intended to wind up the used cloth T'; a guide groove 20 enlarged at the top is used to facilitate the insertion of the drive.

Further members, such as a guide groove 23 and a vertical groove 43 which opens into a linear set of teeth 44, are intended for the parallel guidance of a fabric receptacle (likewise not shown here) in which the roll of clean cloth T is mounted vertically displaceably.

It is clearly evident from FIG. 10 that the compensator roller 50, indicated in the rear position thereof, blocks the used cloth T' on the path-limiting members 50' and, in conjunction with the reversing roller 9 mounted in the pivoting unit 2, cf. FIG. 1, prevents it from being withdrawn. This results in a so-called return lock In this Figure one of the parallel guides 45 is also seen, having a parallel set of teeth 46 which is situated at the top and which guides the compensator roller 50 in an axially parallel manner into the front position as indicated in broken line. The oscillation path is also designated p in this case. A bearing pin 54, which projects out of the front face of the compensator roller 50 and on which the traction cable 60 is suspended, FIG. 9 and FIG. 11, may likewise be seen. For the sake of completeness, part of the cover 25 with a bearing pin 24 for performing further functions is also indicated.

Figure 11:
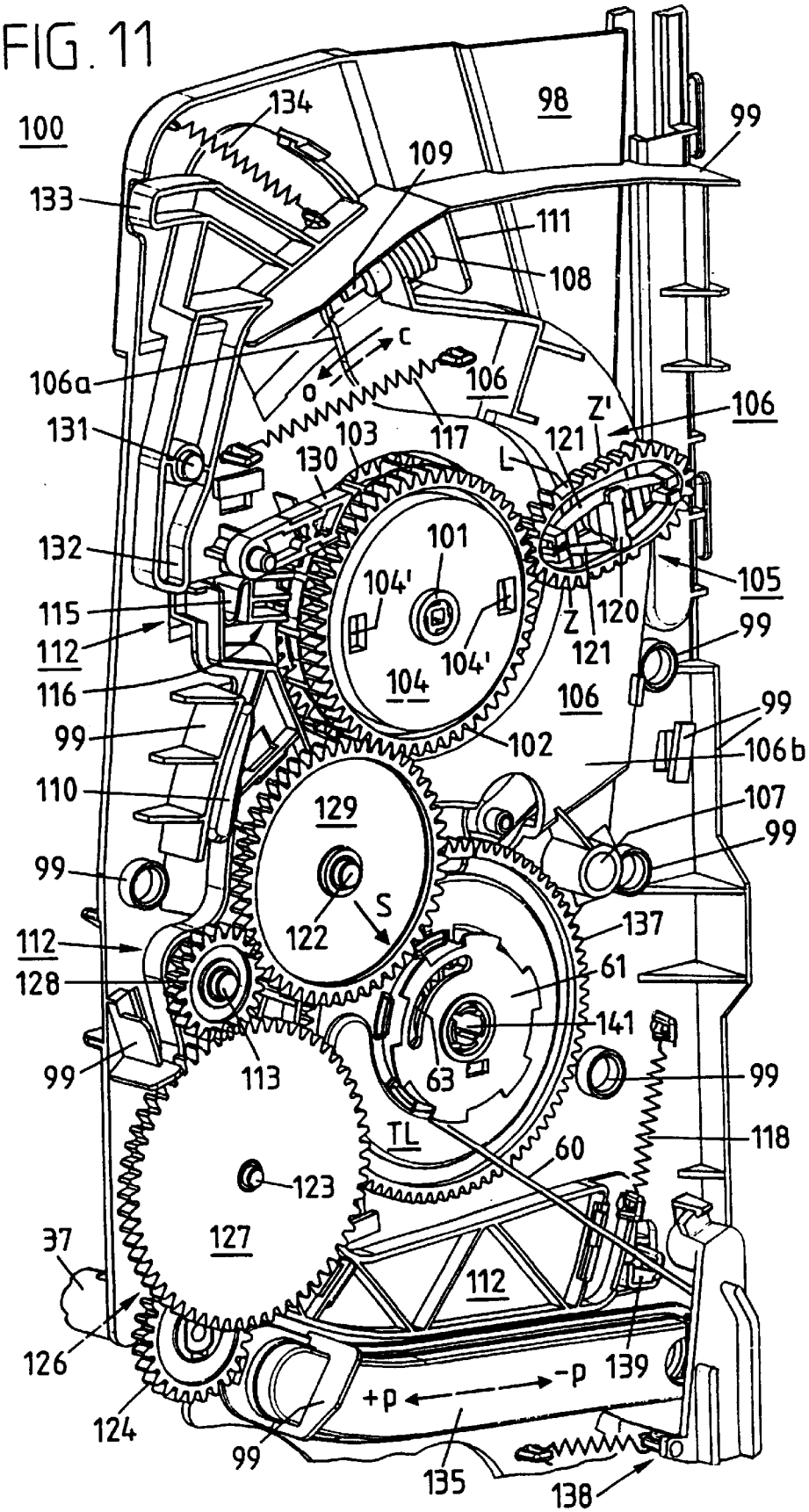
FIG. 11 is a perspective illustration of the time- and path-dependent control unit of the dispenser according to FIGS. 1 to 10 with the gearing mechanisms and switching members thereof.

In FIG. 11, a simplified illustration of a control device is designated 100, the corresponding coverings and protective covers as well as non-functional gearing parts having been removed.

The control and drive device 100 essentially comprises two units, a release and switching rocker 106 and a pivoting gearing mechanism 112. The release and switching rocker 106 is mounted on a rotation shaft 107 and is arranged around two wheels 102 and 103 respectively. The front wheel 102 is a transmission gearwheel, whereas the rear, covered wheel 103 is the central gearwheel already described. A spiral spring 104, which engages on the common shaft of the two wheels 102, 103 and is stressed in the anti-clockwise direction, is inserted in the interior of the transmission gearwheel 102. The spiral spring 104 is situated in a housing, and its state of stressing can be monitored through two inspection windows 104'.

Figure 12:
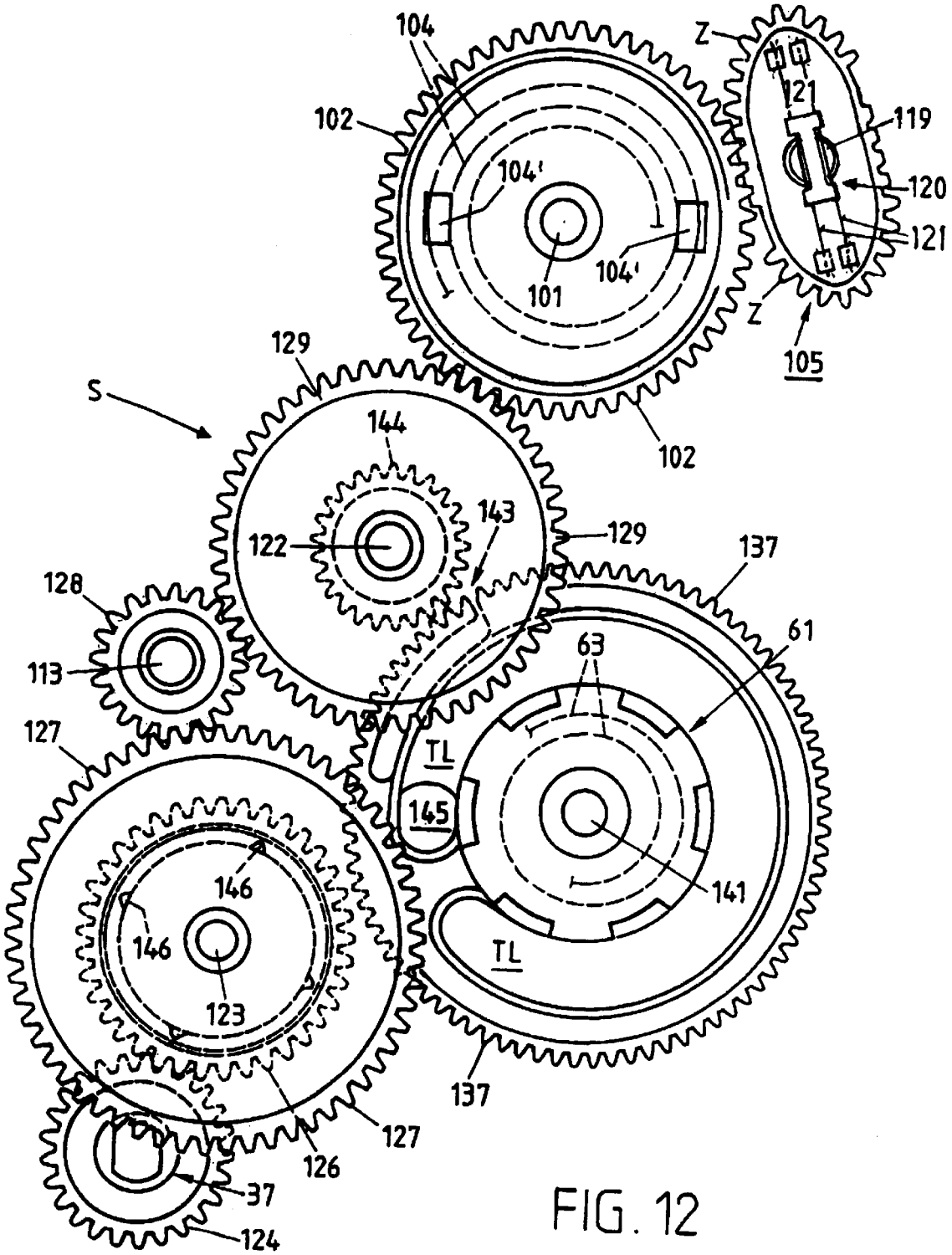
FIG. 12 shows the power flux between the gearwheels in FIG. 11, with the switching gear disengaged.

The rotation shaft 119, see FIG. 12, of an ellipsoid gearwheel 105, which engages its teeth Z on its larger axis with the gearwheel 102, is situated on the release and switching rocker 106. The rocker 106 is constructed in the form of a two-armed lever; the upper lever is designated 106*a* and the lower lever 106*b*. A time-function member 108, 109, which acts upon a counter member 111 and which—as shown in FIG. 11—is in the closed state c, is provided at the end of the upper lever 106*a*.

After further turning of the gearwheel 102 the ellipsoid gearwheel 105 tilts by 90°; the release and switching rocker 106 remains in the engaged position until the interval determined by the time-function member 108, 109 has elapsed.

A pivoting gearing mechanism 112 likewise constructed in the form of a two-armed lever engages over the release and switching rocker 106, and is mounted pivotably on a further rotation shaft 123 and engages with its upper lever part in the rear wheel—the central gearwheel 103—by way of a spring member 115 and a gearwheel locking means 116. The pivoting movement required accordingly takes place by way of a switching cam 110 attached to the lower lever 106*b*.

The pivoting gearing mechanism 112 is caused to be restored by a spring 118. Mutually engaging gearwheels are arranged on shafts 122, 113 and the rotation shaft 123.

It is likewise seen that the ellipsoid gearwheel 105 also comprises, in addition to whole teeth Z, flattened teeth Z' and two tooth gaps L. This is advisable in order to permit clear tilting by 90° in the direction of rotation of the gearwheel 105. When the time-function member 108, 109 has reached the specified time, the upper lever 106*a* moves in the direction o, and this is assisted by a further spring 117, a conventional helical spring.

FIG. 11 shows the gearing parts and levers which are advisable for the complete operation of the device 100 in the towel dispenser 1. What is not shown are the necessary coverings and guiding members not essential for operation.

All the parts including supports, webs and engagement points 99 for coverings etc. are provided integrally on a mounting plate 98. A return lock 130, which engages in the transmission gearwheel 102 in the manner of a ratchet or passes thereover, is provided adjacent to the gearwheel 102.

At the front a sensor 133 may be seen, which, stressed by a spring 134, is pressed out of the front face of the mounting plate 98 and establishes the presence of a closed cover (not shown). When the cover is pivoted out or removed, the lever, likewise two-armed and guided on a pivot shaft 131, moves forward with its sensor 133 and with a shifting projection 132 it presses the pivoting gearing mechanism 112 into its retracted position. In this position it stops the central gearwheel 103 by way of the spring 115 and the gearwheel locking means 116, so as to block the entire towel dispenser.

The arrangement of the ellipsoid gearwheel 105 illustrates how the two leaf springs 121 rest only against the front faces of the flat part 120 in the position illustrated, so that a slight torque can tilt the gearwheel 105.

The engagement of the switching cam 110 on the pivoting gearing mechanism 112 is likewise clearly evident, and also the support 99 at the front, which prevents the cam 110 from unintentional action.

In addition, it is possible to see transmission gearwheel 124, which is present at the end of the delivery roller 37 and which engages in a small intermediate wheel 126 covered by a large intermediate wheel 127, a coupling wheel 128, a tensioning wheel 129 and a portioning wheel 137, which is situated partly therebehind and on which is arranged the winding coil 61 with a spiral spring 63 arranged inside. The winding coil 61 uses the same shaft 141 as the portioning wheel 137; the inner coil of the spiral spring 63 acts against the latter and turns the winding coil 61 clockwise against a spring-loaded pin projecting out of the portioning wheel 137.

The traction cable 60 which remains taut, leads from the winding coil 61, spring-loaded thereby, to the compensator roller (not visible here) behind a covering 135. A further lever 139, which engages in a pawl (not visible), is situated in the rear lower part of the assembly plate 98, the pawl being used for unlocking the compensator roller 50, cf. FIG. 9, for its withdrawal by means of the spring-loaded traction cable 60.

FIG. 12 shows all the gearwheels—with the exception of the central gearwheel 103 arranged behind the transmission gearwheel 102 with the same diameter—in engagement or in the possibilities of engagement thereof.

The lowest transmission gearwheel 124 is driven by the delivery roller 37 which rolls as the fabric is drawn out and which is mounted in the pivotable cover (not shown) and from which a torque is transmitted to an intermediate wheel 126 by way of the gear-wheel 124. A large intermediate wheel 127 is arranged, connected on the same shaft 123, in front of the said small intermediate wheel 126. The said large intermediate wheel 127 drives a coupling wheel 128, which in turn engages in a tensioning wheel 129, on the shaft 122 of which a switching wheel 144 rotates jointly.

As shown in FIG. 12, the switching wheel 144 engages—after the gearing mechanism 112 has been pivoted by displacement of the switching cam 110, FIG. 11, in the switching direction S indicated by an arrow—in the portioning wheel 137 and drives it, as far as permitted by an annular cloth-length limit TL. The cloth-length limit TL is constructed in the form of a raised groove with a sector angle of 330, and the path is bounded by a stop pin 145 with an O-ring (not shown in detail) which is used for damping the stop.

The tensioning wheel 129 is continuously in engagement with the transmission gearwheel 102 since the pivoting gearing mechanism 112 undergoes only a small deviation and since, in addition, the rotation shaft 123 thereof is spaced at a relatively large distance from the gearwheel 102, cf. FIG. 11.

The shaft 113 of the coupling wheel 128 is likewise arranged on the pivoting lever 112, so that it jointly rotates and changes the direction of rotation on the gearwheel 129.

Every delivery of towel accordingly causes a rotation of the delivery roller 37 in the clockwise direction, as a result of which the spiral spring 104 is tensioned by an amount, cf. FIG. 11, until after about six deliveries of towel with the central gearwheel 103 likewise fixed on the shaft 101, FIG. 11, the spiral spring 104 enters a rigid coupling in its clockwise direction of rotation.

The spring drive loaded in this way is used to draw in the end of the towel without a remainder when the entire roll of cloth has been used; it thus prevents an unhygienic multiple use of the towel.

With each rotation of the delivery roller 37, a movement of the ellipsoid gearwheel 105 also therefore takes place, so that after a quarter rotation the said ellipsoid gearwheel 105 causes the iaihum deviation of the release and switching rocker 106 illustrated in FIG. 11 in the direction c and produces a vacuum in the springing hollow body 108 (a folding bellows).

Because of the torque transmitted by the gearwheel 102 the ellipsoid gearwheel 105 now receives an impulse, as a result of which it tilts through 90° as a result of the leaf springs 121, cf. FIG. 11, and occupies again the position shown in FIG. 12, but is not yet in the engagement shown there with the gearwheel 102.

After air has arrived in the hollow body 108 by way of the throttle 109, the said hollow body 108 is detached from its counter member 111; the lever 106*a* moves in the direction o; the ellipsoid gearwheel 105 engages with the flattened teeth Z' thereof in the gearwheel 102, so that the starting position is re-established.

The foregoing illustrates and explains the simple and reproducing initiation of the time-function member and the basic movement patterns of the control device.

In addition, the intermediate wheel 126—shown covered—contains an annular slip clutch 146 (also called a catch clutch) known per se with cams (not shown in detail) which prevents damage in the dispenser or to the towel in the event of excessive pulling on the towel.

The portioning wheel 137 is provided with a so-called spring-in point 143, i.e. a springing member in the toothed rim which allows the tensioning wheel 129 to lock in even if the teeth of the two gearwheels 144 and 137 happen to be opposite one another. The locking-in always takes place in the same region of the portioning wheel 137, so that this step also serves to reduce wear.

If the portioning wheel 137 is considered in greater detail, as in FIG. 12, it is possible to explain the portioning, i.e. the delivery of a maximum portion of cloth:

The path limit TL allows only one rotation of the portioning wheel 137 by the path set; when the switching wheel 144 is locked in, the resulting rotational movement is consequently reduced to this amount.

At the same time, however, the rolling path of the towel is also reduced on the delivery roller 37, since the blocking of the portioning gearwheel 137 on the stop pin 145 also acts upon the said roller.

It can be seen that, by inserting intermediate members in the cloth-length limit TL or by a second or displaceable stop similar to the pin 145, the maximum delivery of clean cloth can be adjusted from the current 32 cm, ie. it can be shortened.

The winding coil 61, which is used for drawing in the traction cable 60 illustrated in FIG. 9, is also mounted on the portioning wheel; in this case a spiral spring designated 63, which acts upon the traction cable 60, is likewise evident.

In addition, a further locking lever 138 may be seen which is engaged by the closed cover 25 and which engages in the pivoting unit 2 situated behind the mounting plate 98 and fixes the said pivoting unit 2 in the operating position or releases it when opening the cover 25.

If a towel delivery is now made—and thus an actuation of the control device—the locking lever 139, at the bottom in FIG. 11, is lifted by the rear end of the lever on the pivoting gearing mechanism 112. In this way, the compensator roller present behind the cover 135 and having the already used cloth wound therearound is unlocked; it is activated by the cable line 60 and moves in the direction −p, FIG. 2; this allows the formation of a loop for drying the hands in a convenient and hygienic manner, without considerable quantities of unused cloth having to be expended.

The time-function member 8, 9 can likewise be "programmed", in that the porosity of the throttle 109 can be selected in accordance with the desired dropping time of the hollow body 108. A hollow body 108 comprising a folding bellows produces an adequate retaining force by virtue of its springing-in behaviour. It also allows long switching paths and because of its relatively large volume of air it can be returned in a precise and reproducible manner from the temporary vacuum to atmospheric pressure by way of the throttle 109.

LIST OF REFERENCES

1 towel dispenser
2 pivoting unit
3 shell-shaped guiding and gripping recesses
4 deflecting roller on 2
5 winding roller
5' clamping spring in 5
5" bearing pin of 5
6 friction roller
7 to 9 further deflecting rollers
10 recess for compensator roller
11 shaft pin of 2 (rotation shafts)
12 shaft pin of 6
13 guide groove for 6 (horizontal guide)
14 friction face (nubs)
15 fabric rentable for T (T=cloth)
15' lateral flange of 15
16 guide pin on 15
17 trough for T
18 side panel (on the right)
19 side panel (on the left)
20 enlarged guide groove for 12
21 housing/covering for 103
22 gearing mechanism for friction drive
22' transmission gearwheel/drive of 6
23 guide groove for 16
24 bearing pin
25 cover (covering)
26 sliding cam
27 slide
28 guide strips on 27
29 sliding faces
30 pawl-like cam (fixed)
31 lifting cam on 27
32 projection on 15 (counter cam)
33 locking pawl
34 bearing pin
35 projection/shoulder
36 restoring spring (catching)
37 delivery roller
38 insertion point (bearing) for 5"
39 concentric guide groove
40 rear-wall appliance housing
41 guiding and bearing point for 11
42 pin guide for pivoting lever—filing display
42' bearing for pivoting lever—filling display
43 vertical groove
44 linear set of teeth (toothed racks)
45 parallel guide for 50
46 parallel set of teeth
47 pivoting lever
48 double pin (opposed shaft stubs)
49 slotted guide (cam)
50 compensator roller
50' spring stops for 50/path-limiting members
51 notches
52 gearwheels (parallel guide)
53 lateral guide (flange)
54 bearing pin

55 gripper rocker
56 gripper/recess
57 tensile-spring fastening
58 tensile spring
59 entrainment pin
60 traction cable
60' cable roll
61 winding coil
62 bore in 61
63 spiral spring (integrated drive)
64 bearing pin of 55
65 path limitation—filling display
70 pivoting lever
71 straight slotted gmde
98 mounting plate/switching plate
99 sockets, webs, engagement points
100 control and drive device (without covering)
101 common shaft for wheels 2; 3
102 front wheel (transmission gearwheel)
103 rear wheel (central gearwheel)
104 spiral spring
104' inspection window
105 ellipsoid gearwheel
106 release and switching rocker
106*a* upper lever of 106
106*b* lower lever of 106
107 rotation shaft of 106
108; 109 time-function member
108 resilient hollow body
109 throttle (air)
110 switching cam
111 counter member to 108
112 pivoting gearing mechanism
113 shaft pin of 128
115 spring member
116 gearwheel locking means
117; 118 springs, helical springs (tensile springs)
119 rotation shaft of 105
120 flat part
121 leaf springs
122 shaft pin/shaft of 129 and 144
123 rotation shaft of 112; shaft pin of 126 and 127
124 transmission gearwheel
126 intermediate wheel (small)
127 intermediate wheel (large)
128 coupling wheel
129 tensioning wheel
130 return lock
131 pivot shaft
132 shifting projection
133 sensor (cover)
134 engagement spring
135 covering for compensator roller
137 portioning wheel
138 locking lever—pivoting unit
139 locking lever (pawl)
140 shaft of 40
143 sprnging-in point
144 shifting wheel
145 stop pin (sprung with bring)
146 slip clutch
A rolling direction of T cloth movement
B user
C closing (close)/vacuum
H lifting direction
HB hands of the user
M mounting face (to wall)
o opening direction (open)
p oscillating directions
S switching direction
T towel/roll (clean)
T' towel/roll (used)
V vertical
W winding direction of T'
Z complete teeth
Z' flattened teeth
L tooth gaps

We claim:

1. A towel dispenser for flat strip material, the towel dispenser being of a type with a conveying mechanism for simplified threading-in and for forming a loop of clean strip material suitable for drying hands, wherein the conveying mechanism is provided with a pivoting unit rotatable outwards about a stationary shaft and mounted in side panels, and said conveying mechanism is initiated by a closing of the dispenser by a housing cover and/or by a drive member actuable manually, whereby the strip material is capable of rolling off in portions from a supply of clean material by way of a dispensed loop onto a replaceable roller with used material, characterized in that the pivoting unit (2) is provided in an upper region with bearing points (38) for inserting a removable winding roller (5) in two mutually opposed lateral flanges, a recess (10) for forming an additional loop of strip material (T') is provided between the winding roller (5) and a guide (8, 9, 4) for the strip material (T, T'), and a compensating roller is provided in the recess for following and tightening the additional loop of strip material, the compensator roller (50) being guided axially parallel in two lateral guides (45) and being returnable by a spring-loaded cable line (60; 61).

2. A towel dispenser according to claim 1, characterized in that sets of teeth (46), into which gearwheels (52) arranged at both ends of the compensator roller (50) engage, are provided in the lateral guides (45).

3. A towel dispenser according to claim 2, characterized in that a gripper rocker (55) loaded by a spring (58) engages with a recess (56) over an end side of the compensator roller (50), and the rocker (55) is operatively connected to a cover (25) by way of a stop pin (59).

4. A towel dispenser according to claim 1, characterized in that the pivoting unit (2) is provided with at least one shell-shaped guiding and gripping recess (3), at least one freely rotatable roller (4) projects above the recess (3), a delivery roller (37) is arranged pressing against the cloth (T) below the roller (4) when the cover (25) is closed, and the delivery roller (37) transmits the movement of the cloth in the rolling direction (A) completely to a control and drive device (100).

5. A towel dispenser according to claim 1, characterized in that the pivoting unit (2) is rotatably mounted on two mutually opposed shaft pins (11) in guiding and bearing points (41) in side panels (18, 19) of the dispenser (1), and a slotted guide (49) or set of teeth guiding the pivoting unit (2) laterally and with a limited angle of rotation is provided in at least one of the two side panels (18, 19) of the dispenser (1).

6. A towel dispenser according to claim 1, characterized in that a control and drive device (100) is attached to a side panel (18), and performs a path-dependent synchronous run between the delivery of clean cloth (T) and the winding-up of used cloth (T'), as well as a portioning and time control thereof.

7. A towel dispenser for vertical mounting, in particular on a wall, for flat strip material, the towel dispenser being of a type with a conveying mechanism for simplified threading-in and for forming a loop of clean strip material suble for drying hands, wherein the conveying mechanism is provided with a pivoting unit rotatable outwards about a stationary shaft and mounted in side panels, and said conveying mechanism is initiated by a closing of the dispenser by a housing cover and/or by a drive member actuable manually, whereby the strip material is capable of rolling off in portions from a supply of clean material by way of a dispensed loop onto a replaceable roller with used material, characterized in that the pivoting unit (2) is provided in an upper region with bearing points (38) for inserting a removable winding roller (5) in two mutually opposed lateral flanges, a recess (10) for forming an additional loop of strip material (T') is provided between the winding roller (5) and a guide (8, 9, 4) for the strip material (T, T'), above the pivoting unit (2) a fabric receptacle (15) for clean cloth (T) guided in side panels (18, 19) of the dispenser (1) is mounted displaceably in a vertical plane parallel to the said side panels (18, 19), an underside of said fabric receptacle (15) supports a friction roller (6) for loading and driving the winding roller (5) with used cloth (T'), the friction roller being operatively connected to a gearing mechanism provided on one side panel, a vertical guide groove passing into a curved guide groove (20, 39) is formed in at least one of the two side panels (18, 19), and mutay opposed horizontal guide grooves (13), which guide the gearing mechanism (22) with non-positive locking in the vertical plane irrespectively of the increasing diameter of the winding roller (5) around which the used cloth (T') is wound, are provided in the two lateral flanges (15') of the fabric receptacle (15).

8. A towel dispenser according to claim 7, characterized in that grooves (43) and linear sets of teeth (44), into which guides at the rear of the fabric receptacle (15) engage, are formed in a rear wall (40) of the dispenser (1).

9. A towel dispenser according to claim 8, characterized in that the guides at the rear of the fabric receptacle (15) are gearwheels projecting from the fabric receptacle (15) and coupled to one another sdas to be freely rotatable.

10. A towel dispenser.according to claim 7, characterized in that the fabric receptacle (15) can be lifted by a lateral projection (32) by way of a slide (27) with a lifting cam (31) in a vertical lifting direction (H).

11. A towel dispenser according of claim 10, characterized in that the slide (27) has a base arranged at an oblique angle and having a sliding face (29) coming into engagement as a result of a sliding cam projecting on the inside on a cover (25) of the dispenser (1).

12. A towel dispenser according to claim 7, characterized in that a bearing (42') is attached to a side panel (18), and a pin guide (42) for a pivoting lever of a filling-state indicator for the supply of cloth (T) is inserted, which establishes and indicates the vertical position of the fabric receptacle (15).

13. A towel dispenser for flat strip material, the towel dispenser being of the type with a conveying mechanism for simplified threading-in and for forming a loop of clean strip material suitable for drying hands, wherein the conveying mechanism is provided with a pivoting unit rotatable outwards about a stationary shaft and mounted in side panels, and the said conveying mechanism is initiated by a closing of the dispenser by a housing cover and/or by a drive member actuable manually, whereby the strip material is capable of rolling off in portions from a supply of clean material by way of a dispensed loop onto a replaceable roller with used material, characterized in that the pivoting unit (2) is provided in an upper region with bearing points (38) for inserting a removable winding roller (5) in two mutually opposed lateral flanges, a recess (10) for forming an additional loop of strip material (T') is provided between the winding roller (5) and a guide (8, 9, 4) for the strip material (T, T'), vertical guide grooves (23), into which guide pins (16) projecting in pairs out of the lateral flanges of a fabric receptacle (15), are formed in side panels (18, 19) of the dispenser.

* * * * *